United States Patent [19]

Muller

[11] Patent Number: 5,058,340

[45] Date of Patent: Oct. 22, 1991

[54] CUSTOM STRETCHED CEILINGS

[76] Inventor: Jurgen H. Muller, P.O. Box 4178, Fort Pierce, Fla. 34948

[21] Appl. No.: 494,623

[22] Filed: Mar. 16, 1990

[51] Int. Cl.[5] ..... E04B 5/60

[52] U.S. Cl. ..... 52/222; 52/273; 52/63; 160/395

[58] Field of Search ..... 52/222, 273, 63; 160/395

[56] References Cited

U.S. PATENT DOCUMENTS

| | | | |
|---|---|---|---|
| 3,186,129 | 6/1965 | Blood | 52/222 X |
| 3,205,628 | 9/1965 | Frisk | 52/222 |
| 3,405,489 | 10/1968 | Frisk | 52/222 |
| 3,719,013 | 3/1973 | Blick | 52/222 |
| 4,083,157 | 4/1978 | Anthonioz | 52/222 |
| 4,408,433 | 10/1983 | Scherrer | 52/222 X |
| 4,711,060 | 12/1987 | Scherrer | 52/222 |
| 4,788,806 | 12/1988 | Sease | 52/222 |
| 4,835,914 | 6/1989 | Scherrer | 52/222 X |

FOREIGN PATENT DOCUMENTS

| | | | |
|---|---|---|---|
| 43466 | 1/1982 | European Pat. Off. | 52/222 |
| 1214421 | 12/1970 | United Kingdom | 52/222 |

*Primary Examiner*—John E. Murtagh
*Assistant Examiner*—Deborah McGann Ripley
*Attorney, Agent, or Firm*—Alvin S. Blum

[57] ABSTRACT

A smooth, flat plastic film sheet forms a ceiling covering. The dimensions of the room are measured. The dimensions are proportionately reduced. A plastic sheet film is prepared to the reduced dimensions. A plastic edge connector is ultrasonically welded to the entire periphery. A connector strip is fastened to the upper wall entirely around the room. Hot air is blown to the top of the room. The edge connector at the edge of the film is snapped into the connector strip, starting at the corners. The film and edge connector are of a plastic that stretches when hot. The edge connector, when completely fitted into the connector strip pulls the film taut as the film shrinks when cooled to room temperature to provide a perfectly fitted, wrinkle free covering. The same invention may be used to cover a wall. The special edge connector is provided with a snap latching feature to provide audible indication of correct locking in place and the edge connector has a provision for easy unlatching for removing the covering.

7 Claims, 2 Drawing Sheets

FIG. 2
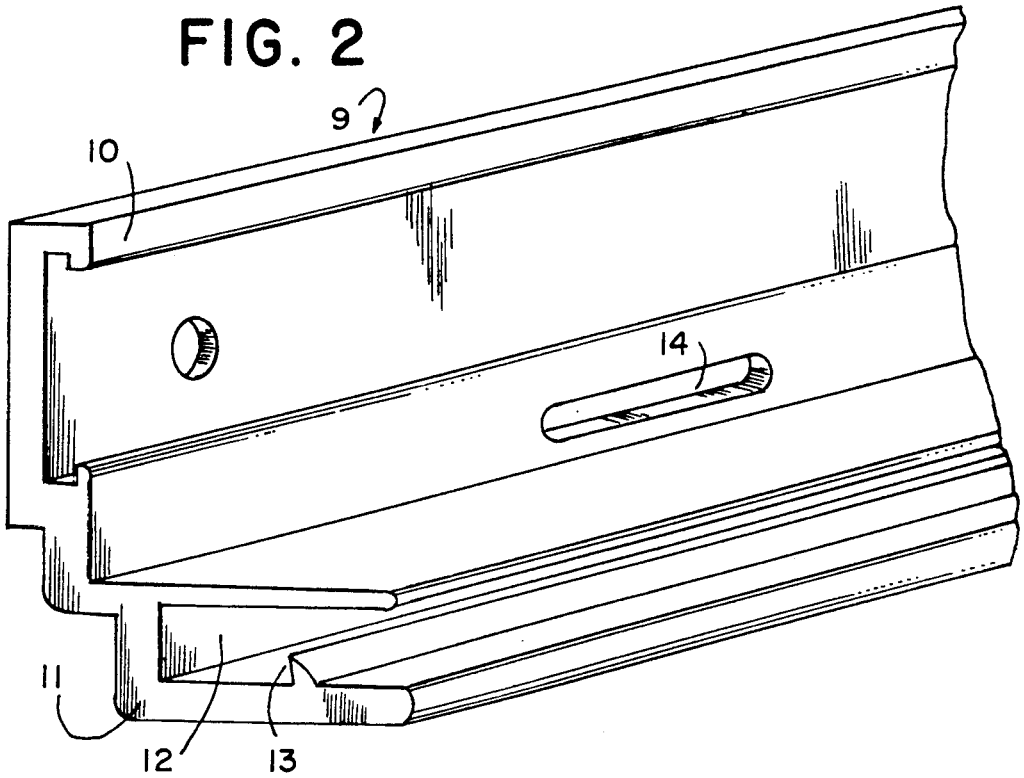
FIG. 6
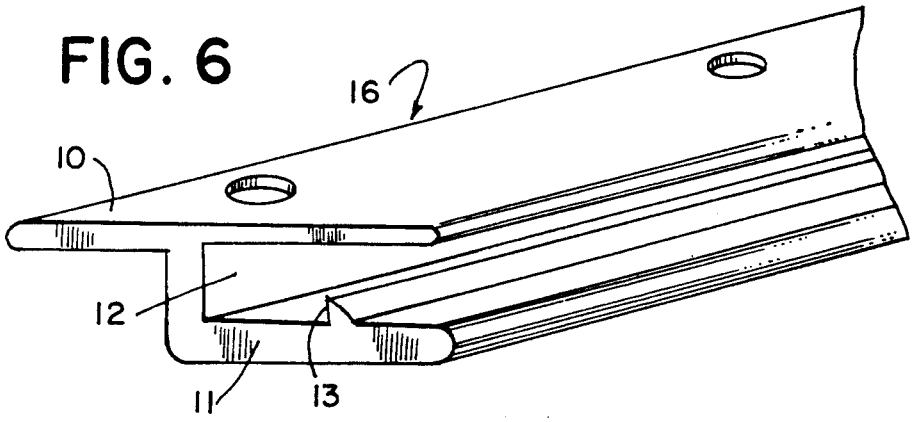
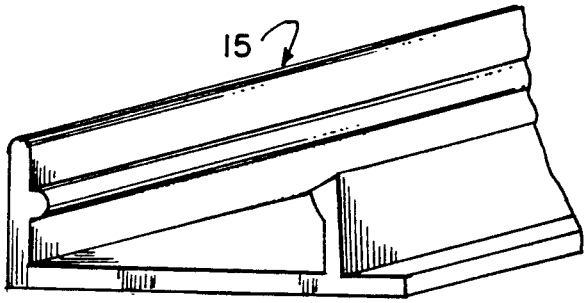
FIG. 5

CUSTOM STRETCHED CEILINGS

BACKGROUND OF THE INVENTION

This invention relates to ceilings and more particularly to thin plastic film ceiling structures and means of production and installation thereof.

Conventional ceiling structures generally include a thick, rigid layer of gypsum for fire retardency properties. To improve the appearance of the ceiling, it is generally provided with a decorative undersurface visible from the room. This decorative surface may be a paint or sheet material affixed to the ceiling. Alternatively, a drop, or suspended, ceiling may be hung below the structural ceiling. This includes an open framework hung from the structural ceiling that carries squares of ceiling tiles that may have sound absorbing as well as decorative features. This suspended ceiling is more commonly found in situations where ducts, pipes and the like must be concealed from view. It is very labor intensive to install a suspended ceiling. Even a small water leak discolors it and it provides no barrier to a larger water leak that may damage the room contents. To provide decorative effects other than a planar surface with ceilings of the prior art is expensive and disruptive of the use of the room for the considerable time of installation. The ceilings of the prior art are also difficult to clean and redecorate, especially the acoustic type which may have a very irregular, absorbent surface with many perforations. Where ceilings or walls have asbestos fibers, it may be more effective to cover the room surface with an impervious film barrier than to remove the asbestos.

Custom stretched ceilings have been used in France and Germany with a hook type of attachment to the wall (FIG. 1).

SUMMARY OF THE INVENTION

It is accordingly an object of the invention to provide a decorative ceiling system that is installed with less labor and less disruption of the room. It is another object of the invention to provide a ceiling that has desirable sound absorbing properties. It is yet another object of the invention to provide a ceiling that is easily cleaned and maintained. It is yet another object of the invention to provide a ceiling that can be applied a distance below a fixed ceiling to conceal items at the top of the room. It is yet another object to provide a ceiling that may be suspended only from the walls of the room and that may have diverse, non planar shapes. It is yet another object of the invention to provide a ceiling resistant to water leaks.

The ceiling of the invention comprises a thin plastic film with a resilient plastic edge connector fused along its perimeter. A mating connecting strip is affixed to the wall to receive the edge connector and hold it securely in place. The film with its edge connector is custom made to the dimensions of the room but in a reduced size. At installation, the top of the room is heated with hot air. The film is of such material that it easily stretches when heated. The hot film is installed by snapping the edge connector into the connecting strip that has been affixed to the wall at ceiling height. The film stretches to fit the room. When cooled, the film shrinks toward its original dimensions, pulling taut to provide a film under tension. It can thus span considerable distance without sagging. This is because the film is very thin and weighs very little. Consequently, there is very little gravitational force pulling it down between regions of attachment. Having a soft, resilient surface, the ceiling provides desirable sound absorbent properties while retaining the easy cleaning, non-staining characteristics of plastic film. Furthermore, it is an excellent barrier to water, protecting the room from leaks. The invention may be used to cover a wall as well.

A simple tool is used for installation and one can be assured of proper locking of the connector by listening for the audible sound of the connectors snapping together. Another simple tool can be used to unlock the connector to remove the film without damage to the edge connector or connecting strip. A cover strip covers the junction of the two connectors.

These and other objects, advantages and features of the invention will become more apparent when the detailed description is studied in conjunction with the accompanying drawings.

BRIEF DESCRIPTION OF THE DRAWINGS

FIG. 2 is a perspective view of the connecting strip.

FIG. 5 is a perspective view of the cover strip.

FIG. 6 is a perspective view of an alternative connecting strip.

DETAILED DESCRIPTION OF PREFERRED EMBODIMENTS

Figure 1:
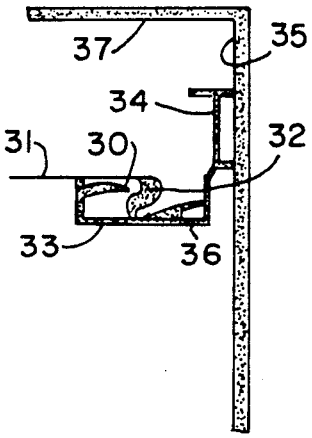
FIG. 1 shows a sectional view of a portion of a stretched ceiling of the prior art.

Referring now first to FIG. 1 a stretched film ceiling that was used in France and Germany is shown applied below rigid ceiling 37. A rigid connector strip 36 is affixed to wall 35 by a support portion 34. A connecting portion 33 has a top opening to receive a hook type connector 32 that is heat sealed to plastic film 31. The film and connector are of heat stretching polyvinyl chloride. The heated film is installed by forcing the hook portion of the connector 32 over the top limb 30 of the connecting portion 33 of connector strip 36 and then down so that it will hook onto the top limb 30 as the film cools and shrinks. The installer can force the hook of the connector down with one hand while stretching the film with the other hand to ensure that the connector is securely in place. However, when some of the connector is locked in place, the installed film prevents access from above. Blind insertion of the connector occasionally fails to lock the connector hook beneath limb 30 of the connector strip 36. This results in failure of the connection as the film shrinks and tension is gradually increased. The film pulls away from the wall, and the installer must return one or more times to correct the problem. Furthermore, the heat sealing of the film to the connector changes the film properties so that the film to connector seal may break loose as well. Poor control over quality of installation and repeated repairs have made the system very costly. The instant invention overcomes these defects to provide a lower cost and higher quality installation with reduced failure.

Figure 7:
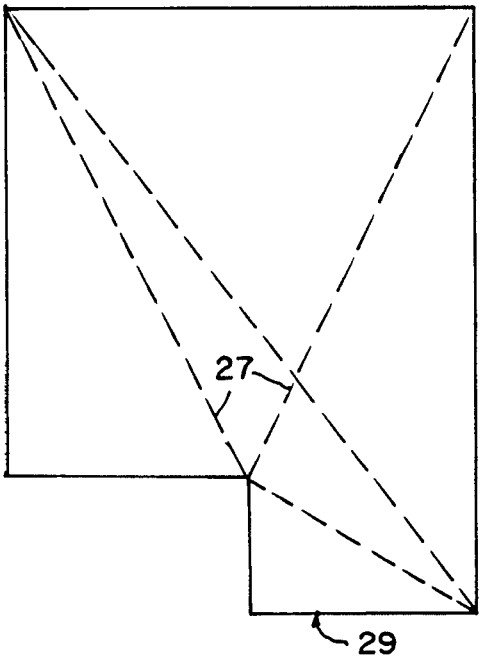
FIG. 7 PRIOR ART
FIG. 7 is a diagrammatic plan view representation of a room whose ceiling is to be covered with the invention.
Figure 4:
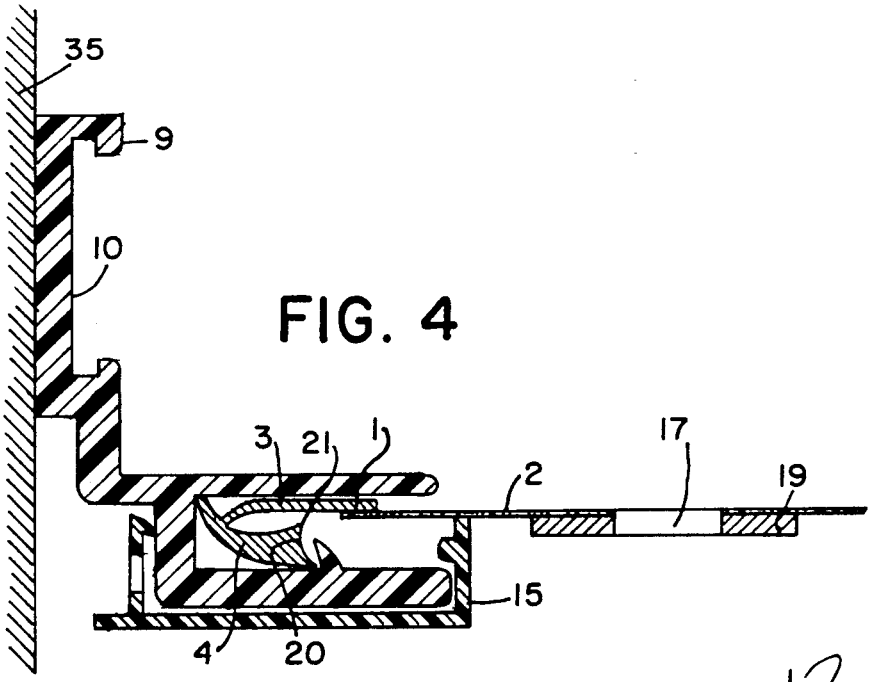
FIG. 4 is a sectional view of a portion of the stretched ceiling in place on a wall.
Figure 3:
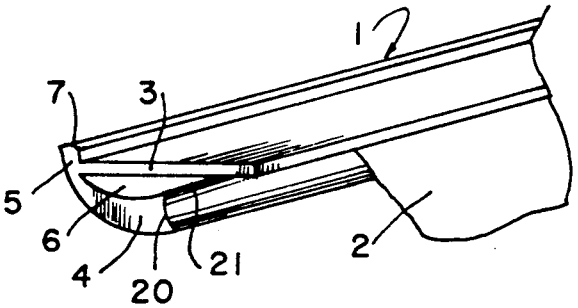
FIG. 3 is a perspective view of the edge connector.

Referring now to FIG. 7, a room 29 in which a ceiling of the invention is to be installed is carefully measured, including diagonals 27 to ensure accuracy. The dimensions are than proportionately reduced mathematically and a sheet of PVC (Polyvinylchloride) plastic film is prepared to the reduced dimensions. This may include ultrasonic welding together of smaller pieces. A resilient PVC profile extrusion 1, (FIGS. 3, 4) is cut to fit the perimeter of the film 2 and the film perimeter is ultrasonically welded to limb 3 of the edge connector 1. A second limb 4 of the connector 1 is joined to the first limb 3 by joining member 5, leaving a space 6 for insertion of a flat, spatula-like installation tool for insertion of the edge connector into connector strip 9 that is formed of a more rigid plastic profile extrusion. The connector strip 9 (FIGS. 2, 4) includes an attaching portion 10 for attaching to a wall surface 35 near the rigid ceiling by screws, staples, cement and other fastening means well known in the art. At right angles to the attaching portion is an edge connector engaging portion 11 that includes a channel 12 that receives the edge connector 1. The channel is so narrow relative to the thickness of the edge connector that the two limbs of the edge connector are forced together. When the outer edge of the bottom limb 4 of the edge connector moves past latching ridge 13 it springs down elastically behind the ridge, latching the connector securely in place. The projection 7 on the joining member 5 of the connector further enhances this springy locking action. When this snaps in place, the sound is heard by the installer. This ensures complete installation security. Ventilating apertures 14 may be provided to permit movement of water vapor to prevent condensation. The connector strip 16, (FIG. 6) is useful where attachment to a surface parallel to the film is required such as a ceiling beam or skylight frame.

The snap-on cover 15 (FIGS. 4, 5) snaps into place over connector strip 9 and covers the joint of film and connector.

To install the ceiling, the connector strip is fastened to the wall completely around the perimeter of the room. Hot air is blown to the top of the room. The edge connector at each corner of the film is first snapped into the connector strip at each corresponding corner of the room. The heated film easily stretches to conform. Then intermediate points between corners are snapped into place. This is repeated at intermediate points as necessary until the entire edge can be snapped into place. As the film cools and shrinks, plastic memory causes it to pull taut, flat and wrinkle free.

The film may be provided in various colors and surface treatments including mirror and textured. Because the film tears easily if perforated, special treatment is required for apertures for lights, fans, pipes and the like. A thin, stiff plastic plate 19 (FIG. 4) such as 1/32 inch polycarbonate is cemented to the concealed face of the film surrounding the aperture 17 thereby forming a tear-proof plastic border at the aperture so that the stresses are removed from the film.

Means are provided for conveniently unlatching the connector 1 from the connector strip 9 when it is necessary to remove the film. The second, lower limb 4 of the edge connector is provided with a grooved edge 20 that leaves a lip 21 accessible when the lower portion of the edge is latched behind the latching ridge 13. This lip may be engaged by a thin flat tool and lifted upward to lift the lower edge above the latching ridge, thereby unlatching the connector. Because the stretched film is under tension, the edge connector will pull free from the channel in the connector strip as soon as this unlatching occurs.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

I claim:

1. A custom interior room surface covering for a room having a plurality of walls comprising:

a) a plastic film sheet having a shape and a perimeter corresponding to a surface of said room and having dimensions proportionately reduced from the dimensions of said surface;

b) resilient elongate edge connector means for removably connecting said film sheet to said walls of said room, said connector means being attached to said perimeter of said film sheet;

c) elongate connector-engaging strip means for removably holding said connector means against a surface, said strip means having a surface attaching portion for fixedly attaching to surfaces, said surfaces including walls and ceilings and a connector-engaging portion for removably engaging said edge connector means for holding said film sheet against said surface;

d) said edge connector means having a cross section comprising a first limb to which said film sheet is attached; a second limb thicker than said first limb and arranged beside said first limb; a joining member joining said first and second limbs together at one end with said limbs spaced apart from one another at a second end by a space adapted for receiving a tool for pushing against said joining member to force said edge connector means into said connector-engaging portion of said strip means; said second end of said second limb provided with both latching means for latching engagement of said strip means and releasing means for releasing said latching engagement, said joining member provided with an extension projecting transversely to the plane of said first limb and away from said second limb;

e) said connector-engaging portion of said strip means comprising two spaced apart arms joined together at a base defining a channel space for receiving said edge connector means therein, said arms comprising a first arm having a smooth face bordering said channel space to facilitate sliding passage of said extension thereupon during installation and removal and a second arm having a latching ridge means extending into said channel space and sloping away from the open end for latching engagement of said latching means of said edge connector means as said edge connector means is forced into said connector-engaging portion of said strip means;

f) audible indicator means for emitting an audible signal upon latching of said latching means as said connector means is latched within said channel, said extension cooperating with said first arm to force said second end of said second limb elastically against said second arm to produce said signal upon latching; and g) said releasing means including a projecting lip on said second end of said second limb, said lip arranged to project beyond said latching ridge means sufficiently to be accessed through said open end of said channel when said connector means is latched, whereby forcing said lip toward said first limb releases said latching means of said second limb to thereby release said connector means from said channel while said extension slides unobstructed along said smooth face of said first arm.

2. The covering according to claim 1 in which said film sheet and said edge connector means are composed of material including polyvinyl chloride plastic.

3. The covering according to claim 1 in which said film sheet is non-inflammable and has the property of melting and shrinking to said strip means when subjected to a flame to protect occupants from drops of melted plastic.

4. The covering according to claim 1 in which said second end of said second limb of said edge connector means is provided with a grooved edge to provide both said latching means and said releasing means.

5. The covering according to claim 1 in which said connector-engaging strip means has ventilating apertures between said surface attaching portion and said connector-engaging portion to provide ventilation of the space closed off by said film sheet.

6. The covering according to claim 1 further comprising an elongate snap-on cover means for covering the junction between said strip means and said connector means.

7. The covering according to claim 1, including tear-proof apertures in said film sheet, said apertures provided with a tear-proof, non-stretchable sheet plastic border cemented to said film sheet.

* * * * *